US009773366B2

(12) United States Patent
Graham

(10) Patent No.: US 9,773,366 B2
(45) Date of Patent: Sep. 26, 2017

(54) GAMING SYSTEM AND A METHOD OF GAMING

(75) Inventor: Philippa Alice Graham, Clovelly (AU)

(73) Assignee: ARISTOCRAT TECHNOLOGIES AUSTRALIA PTY LTD (AU)

( * ) Notice: Subject to any disclaimer, the term of this patent is extended or adjusted under 35 U.S.C. 154(b) by 1486 days.

(21) Appl. No.: 11/970,937

(22) Filed: Jan. 8, 2008

(65) Prior Publication Data

US 2008/0167114 A1 Jul. 10, 2008

(30) Foreign Application Priority Data

Jan. 9, 2007 (AU) ..... 2007900085

(51) Int. Cl.
*G07F 17/34* (2006.01)
*G07F 17/32* (2006.01)

(52) U.S. Cl.
CPC ..... *G07F 17/32* (2013.01); *G07F 17/3286* (2013.01); *G07F 17/34* (2013.01)

(58) Field of Classification Search
USPC ..... 463/20
See application file for complete search history.

(56) References Cited

U.S. PATENT DOCUMENTS

| | | | | |
|---|---|---|---|---|
| 5,997,401 | A * | 12/1999 | Crawford | 463/20 |
| 6,270,412 | B1 * | 8/2001 | Crawford et al. | 463/20 |
| 6,419,579 | B1 | 7/2002 | Bennett | |
| 6,517,432 | B1 * | 2/2003 | Jaffe | 463/16 |
| 6,551,187 | B1 * | 4/2003 | Jaffe | 463/20 |
| 6,918,832 | B2 * | 7/2005 | Baerlocher et al. | 463/20 |
| 7,077,745 | B2 | 7/2006 | Gomez et al. | |
| 7,744,457 | B2 * | 6/2010 | Gauselmann | 463/20 |
| 7,753,769 | B2 * | 7/2010 | Gomez et al. | 463/16 |
| 2004/0023714 | A1 * | 2/2004 | Asdale | 463/22 |
| 2004/0033829 | A1 | 2/2004 | Pacey et al. | |
| 2004/0048646 | A1 * | 3/2004 | Visocnik | 463/16 |
| 2004/0048650 | A1 * | 3/2004 | Mierau et al. | 463/20 |
| 2005/0054418 | A1 | 3/2005 | Baerlocher | |
| 2005/0054420 | A1 | 3/2005 | Cregan et al. | |
| 2006/0073876 | A1 | 4/2006 | Cuddy | |
| 2006/0189377 | A1 * | 8/2006 | Gomez et al. | 463/20 |

FOREIGN PATENT DOCUMENTS

| | | | |
|---|---|---|---|
| AU | 2007231804 | A1 | 5/2008 |
| WO | 2007018680 | A1 | 2/2007 |

* cited by examiner

*Primary Examiner* — Jay Liddle
(74) *Attorney, Agent, or Firm* — McAndrews, Held & Malloy, Ltd.

(57) ABSTRACT

A gaming system is disclosed which comprises a symbol selector arranged to select a plurality of symbols from a set of symbols for display in a display area, an outcome generator arranged to determine a game outcome based on the displayed symbols and to provide a player reward when the displayed symbols correspond to a win outcome, and a symbol modifier arranged to automatically modify at least one symbol so that the displayed symbols after modification of the at least one symbol correspond to an optimum win outcome. A corresponding method is also disclosed.

11 Claims, 8 Drawing Sheets a)

| 304 | 306 | 308 | 310 | 312 |
|---|---|---|---|---|
| Queen | King | Ace | Jack | 10 |
| 9 | 9 | Wild | 10 | King |
| Jackpot | Queen | Jackpot | Jackpot | 9 |

320

45 b)

| 304 | 306 | 308 | 310 | 312 |
|---|---|---|---|---|
| Queen | King | Ace | Jack | 10 |
| 9 | 9 | 10 | 10 | King |
| Jackpot | Wild | Jackpot | Jackpot | 9 |

45

Fig. 8 a)

| 304 | 306 | 308 | 310 | 312 |
|---|---|---|---|---|
| Queen | King | Ace | Jack | 10 |
| 9 | 9 | 10 | 10 | King |
| Jackpot | Queen | Jackpot | Jackpot | 9 |

45 b)

| 304 | 306 | 308 | 310 | 312 |
|---|---|---|---|---|
| Queen | King | Ace | Jack | 10 |
| 9 | 9 | 10 | 10 | King |
| Jackpot | Cashman | Jackpot | Jackpot | 9 |

322

45

Fig. 9

GAMING SYSTEM AND A METHOD OF GAMING

CROSS REFERENCE TO RELATED APPLICATIONS

This application claims priority to Australian Patent Application No. AU2007900085, having an international filing date of Jan. 9, 2007, entitled "A Gaming System and a Method of Gaming", which is hereby incorporated by reference herein in its entirety.

FIELD OF THE INVENTION

The present invention relates to a gaming system and to a method of gaming.

BACKGROUND OF THE INVENTION

It is known to provide a gaming system which comprises a game controller arranged to randomly display several symbols from a predetermined set of symbols and to determine a game outcome such as a game win based on the displayed symbols. Such gaming systems may commonly be implemented as a stepper machine provided with reels with each reel carrying several symbols of the set, or a video machine wherein selected symbols are displayed on virtual reels on a graphical display device.

It is also known to provide a gaming system which operates such that a wild symbol progressively moves along a predetermined path with game outcomes being determined for each position along the path.

However, while such gaming systems provide users with enjoyment, a need exists for alternative gaming systems in order to maintain or increase player enjoyment.

SUMMARY OF THE INVENTION

In accordance with a first aspect of the present invention, there is provided a gaming system comprising:

a symbol selector arranged to select a plurality of symbols from a set of symbols for display in a display area;

an outcome generator arranged to determine a game outcome based on the displayed symbols and to provide a player reward when the displayed symbols correspond to a win outcome; and a symbol modifier arranged to automatically modify at least one symbol so that the displayed symbols after modification of the at least one symbol correspond to an optimum win outcome.

In one embodiment, the symbol position modifier is arranged to automatically move at least one displayed symbol from a first display position in the display area to a second display position in the display area.

In an alternative embodiment, the symbol position modifier is arranged to automatically move at least one displayed symbol from a first display position outside of the display area to a second position in the display area.

In one embodiment, the optimum win outcome is a win outcome having the highest possible monetary payout.

In one arrangement, the gaming system comprises a display device.

The display device may be arranged to display graphical representations of a plurality of reels, each reel including a plurality of associated symbols.

The set of symbols may include at least one function symbol having an associated function which may be a wild function, a scatter function, a multiplier function, a repeat win function or a jackpot function.

The symbol to be moved may be a symbol having an associated function, such as a wild symbol.

When a symbol is moved from a display position in the display area, a randomly selected symbol may replace the moved symbol, a symbol disposed at a first display position is copied to the second display position, a predefined replacement symbol associated with the display position may be displayed, or the symbol to be moved and a symbol associated with the display position to which the symbol is to be moved may swap positions.

When a symbol is moved from a first display position in the display area, the gaming system may be arranged to display both a replacement symbol and a movable symbol at the first display position.

The symbol to be moved may be a specific symbol, a symbol displayed at a specific display position, or a randomly selected symbol or display position.

In an alternative embodiment, the gaming system may be arranged to display a representation of a bingo card, the bingo card including the selected symbols.

In a further alternative embodiment, the gaming system may be arranged to display graphical representations of a plurality of cards, each card including one symbol.

In one embodiment, the gaming system is arranged to operate in normal game mode and special game mode, and the symbol position modifier is arranged to modify at least one symbol only when the gaming system operates in special game mode.

The gaming system may be arranged to commence special game mode when a predetermined game outcome occurs, on the basis of a game event occurring during a game such as display of a particular symbol or combination of symbols, in response to player input, based on the amount or type of bet placed, or when a special game is purchased by a player.

In one arrangement, a plurality of symbols are modified by the symbol position modifier.

The gaming system may be implemented as a stand alone gaming machine or across a network.

In accordance with a second aspect of the present invention, there is provided a method of gaming comprising:

selecting a plurality of symbols from a set of symbols for display in a display area;

if a win outcome is available by modifying at least one symbol, automatically modifying the at least one symbol so that the displayed symbols after modification of the at least one symbol correspond to an optimum win outcome; and determining a game outcome based on the displayed symbols after modification of the at least one symbol.

In accordance with a third aspect of the present invention, there is provided a computer program arranged when loaded into a computer to instruct the computer to operate in accordance with a gaming system comprising:

a symbol selector arranged to select a plurality of symbols from a set of symbols for display in a display area;

an outcome generator arranged to determine a game outcome based on the displayed symbols and to provide a player reward when the displayed symbols correspond to a win outcome; and a symbol position modifier arranged to automatically modify at least one symbol so that the displayed symbols after modification of the at least one symbol correspond to an optimum win outcome, wherein the at least one symbol is only modified if a win outcome is available by modifying the at least one symbol.

In accordance with a fourth aspect of the present invention, there is provided a computer readable medium having computer readable program code embodied therein for causing a computer to operate in accordance with a gaming system comprising:

a symbol selector arranged to select a plurality of symbols from a set of symbols for display in a display area;

an outcome generator arranged to determine a game outcome based on the displayed symbols and to provide a player reward when the displayed symbols correspond to a win outcome; and a symbol position modifier arranged to automatically modify at least one symbol so that the displayed symbols after modification of the at least one symbol correspond to an optimum win outcome, wherein the at least one symbol is only modified if a win outcome is available by modifying the at least one symbol.

In accordance with a fifth aspect of the present invention, there is provided a data signal having computer readable program code embodied therein for causing a computer to operate in accordance with a gaming system comprising:

a symbol selector arranged to select a plurality of symbols from a set of symbols for display in a display area;

an outcome generator arranged to determine a game outcome based on the displayed symbols and to provide a player reward when the displayed symbols correspond to a win outcome; and a symbol position modifier arranged to automatically modify at least one symbol so that the displayed symbols after modification of the at least one symbol correspond to an optimum win outcome, wherein the at least one symbol is only modified if a win outcome is available by modifying the at least one symbol.

BRIEF DESCRIPTION OF THE DRAWINGS

Certain embodiments of the present invention will now be described, by way of example only, with reference to the accompanying drawings, in which:

FIGS. 8*a* to 8*b* are diagrammatic representations of example displayed symbols of a gaming system in accordance with an embodiment of the present invention during implementation of a game;

FIGS. 9*a* and 9*b* are diagrammatic representations of example displayed symbols of a gaming system in accordance with an embodiment of the present invention during implementation of a game.

DESCRIPTION OF CERTAIN EMBODIMENTS OF THE INVENTION

Figure 1:
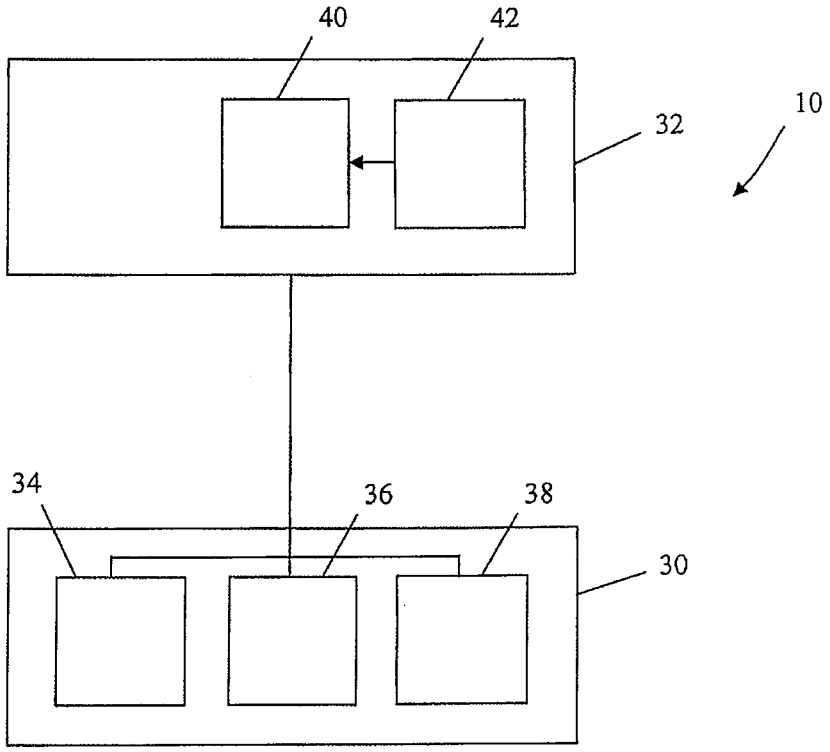
FIG. 1 is a schematic block diagram of core components of a gaming system in accordance with an embodiment of the present invention.

Referring to the drawings, there is shown a schematic block diagram of a gaming system 10 arranged to implement a probabilistic game of the type wherein several symbols from a set of symbols are randomly displayed, and a game outcome is determined on the basis of the displayed symbols. With some such probabilistic games, the set of symbols include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display in the same line, scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions.

The present gaming system operates such that at least during a portion of a game implemented by the gaming system, the gaming system automatically modifies at least one displayed symbol so that the displayed symbols after modification correspond to an optimum win outcome.

The optimum win outcome may correspond to an outcome which provides the highest monetary payout.

Referring to FIG. 1, a schematic diagram of core components of a gaming system 10 is shown. The core components comprise a player interface 30 and a game controller 32. The player interface 30 is arranged to enable interaction between a player and the gaming system and for this purpose includes input/output components required for the player to enter instructions and play the game.

Components of the player interface 30 may vary but will typically include a credit mechanism 34 to enable a player to input credits and receive payouts, one or more displays 36 which may comprise a touch screen, and a game play mechanism 38 arranged to enable a player to input game playing instructions.

The game controller 32 is in data communication with the player interface 30 and typically includes a processor 40 arranged to process game play instructions and output game player outcomes to the display 36. Typically, the game play instructions are stored as program code in a memory 42 that can also be hardwired. It will be understood that in this specification the term "processor" is used to refer generically to any device that can process game play instructions and may include a microprocessor, microcontroller, programmable logic device or other computational device such as a personal computer or a server.

Figure 2:
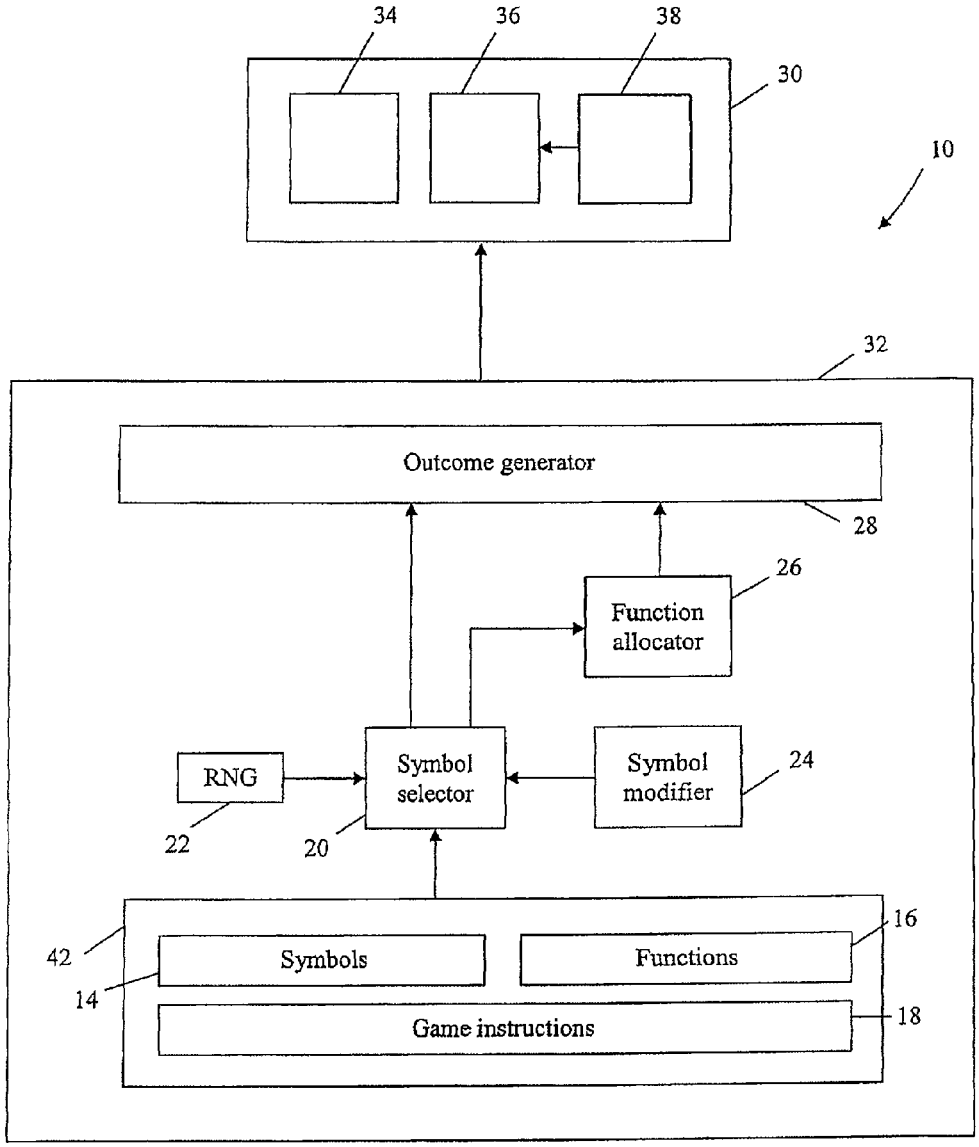
FIG. 2 is a schematic block diagram of functional components of a gaming system in accordance with an embodiment of the present invention.

A functional diagram illustrating operative components of the game controller 32 is shown in FIG. 2.

The memory 42 is arranged to store symbols data 14 indicative of a plurality of symbols for subsequent display to a player, function data 16 indicative of one or more functions allocatable to the symbols, and game instruction data 18 indicative of game instructions usable by the gaming machine 10 to control operation of the game.

The game controller 32 includes a symbol selector 20 which is arranged to select several symbols from the selected symbols 14 for display to a player in an outcome display area. In this example, the selection carried out by the symbol selector is made using a random number generator 22.

It will be appreciated that the random number generator 22 may be of a type which is arranged to generate pseudo random numbers based on a seed number, and that in this specification the term "random" will be understood accordingly to mean truly random or pseudo random.

The game controller 32 also comprises a symbol modifier 24 arranged to automatically modify at least one symbol so that after modification the displayed symbols correspond to an optimum win outcome. This may be achieved in several ways. For example, the symbol position modifier 24 may be arranged to automatically select a new display position to which one of the selected symbols shown in the outcome display area is to be moved in order to produce an optimum win outcome. Alternatively, a special symbol not shown in the outcome display area may be moved from a display location outside the outcome display area to a new display location in the outcome display area in order to produce an optimum win outcome. As a further alternative, a special symbol not shown on the display, may be caused to appear in the outcome display area in place of one of the selected symbols so that an optimum win outcome is defined. A symbol is only modified if modification of one of the symbols will correspond to a win outcome. If no such win outcome is possible, a symbol is not modified or a randomly selected symbol is modified and a consolation prize awarded to the player.

In this example, the game controller 32 also comprises a function allocator 26 arranged to select and allocate one or more functions to one or more symbols. Such functions include a wild function, a scatter function, or any other function which may be applied to a symbol or to the game.

The game controller 32 also comprises an outcome generator 28 which in accordance with the game instructions 18 determines game outcomes based on the symbols selected for display to a player by the symbol selector 20, and on the basis of the symbols displayed after a symbol has been modified by the symbol modifier 24.

In the embodiments described below, the symbol selector 20, the symbol modifier 24, the function allocator 26, and the outcome generator 28 are at least partly implemented using the processor 40 and associated software, although it will be understood that other implementations are envisaged.

The gaming system 10 can take a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 3:
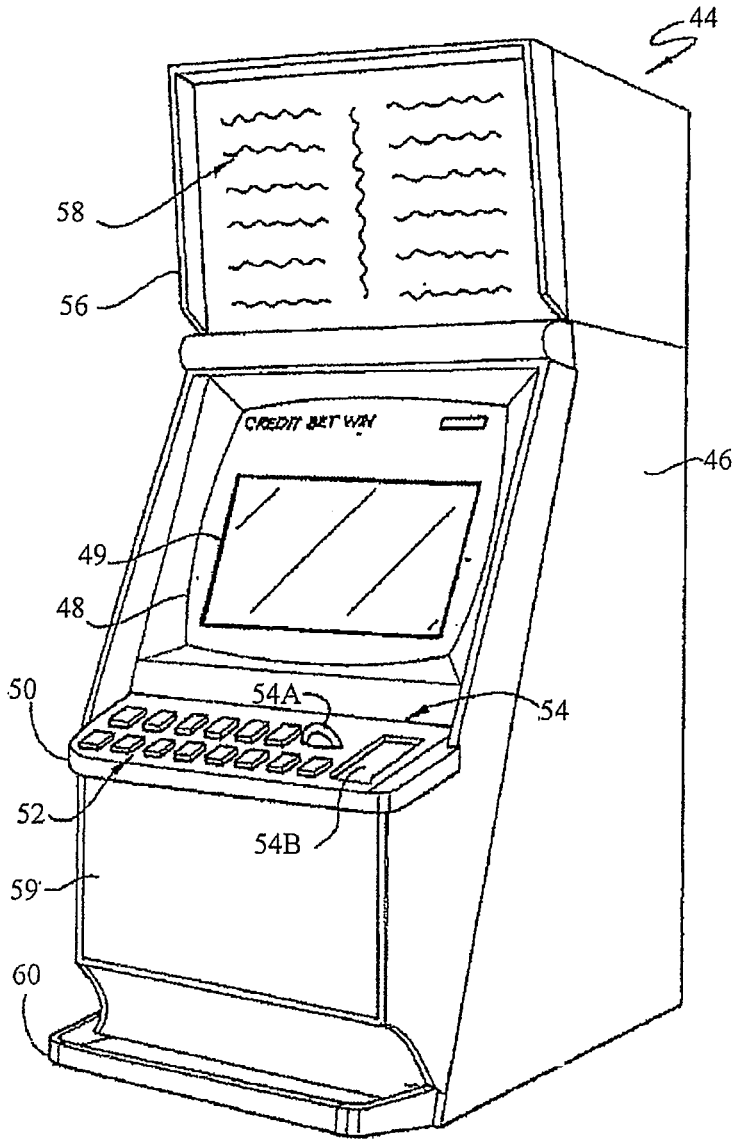
FIG. 3 is a diagrammatic representation of a gaming system in accordance with an embodiment of the present invention with the gaming system implemented in the form of a stand alone gaming machine.

A gaming system in the form of a stand alone gaming machine 44 is illustrated in FIG. 3. The gaming machine 44 includes a console 46 having a display 48 on which is displayed representations of a game 49 that can be played by a player. A mid-trim 50 of the gaming machine 44 houses a bank of buttons 52 for enabling a player to interact with the gaming machine, in particular during gameplay. The mid-trim 50 also houses a credit input mechanism 54 which in this example includes a coin input chute 54A and a bill collector 54B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 56 may carry artwork 58, including for example pay tables and details of bonus awards and other information or images relating to the game. Further artwork and/or information may be provided on a front panel 59 of the console 46. A coin tray 60 is mounted beneath the front panel 59 for dispensing cash payouts from the gaming machine 44.

The display 48 is in the form of a video display unit, particularly a cathode ray tube screen device. Alternatively, the display 48 may be a liquid crystal display, plasma screen, or any other suitable video display unit. The top box 56 may also include a display, for example a video display unit, which may be of the same type as the display 48, or of a different type.

The display 48 in this example is arranged to display representations of several reels, each reel of which has several associated symbols. Typically 3, 4 or 5 reels are provided. During operation of the game, the reels first appear to rotate then stop with typically three symbols visible on each reel. Game outcomes are determined on the basis of the visible symbols together with any special functions associated with the symbols, and if a function has been allocated to a reel, on the basis of the allocated function.

Figure 4:
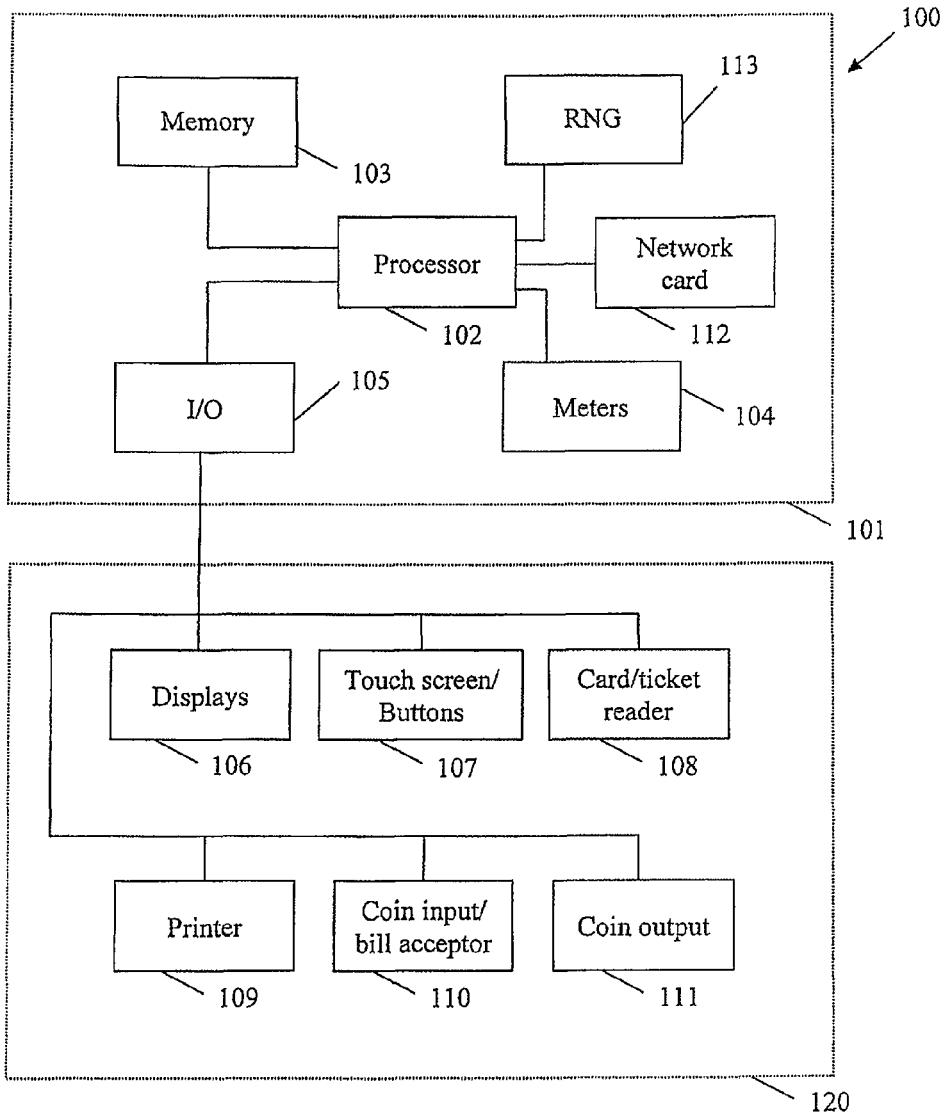
FIG. 4 is a schematic block diagram of operative components of the gaming machine shown in FIG. 3.

FIG. 4 shows a block diagram of operative components of a typical gaming machine 100 which may be the same as or different to the gaming machine shown in FIG. 3.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

Figure 5:
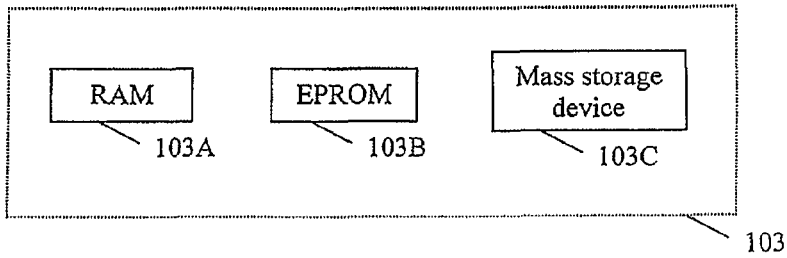
FIG. 5 is a schematic block diagram of components of a memory of the gaming machine shown in FIG. 3.

FIG. 5 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 4, the peripheral devices that communicate with the game controller 101 comprise one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106,107,108,109,110,111 may be provided remotely from the game controller 101.

Figure 6:
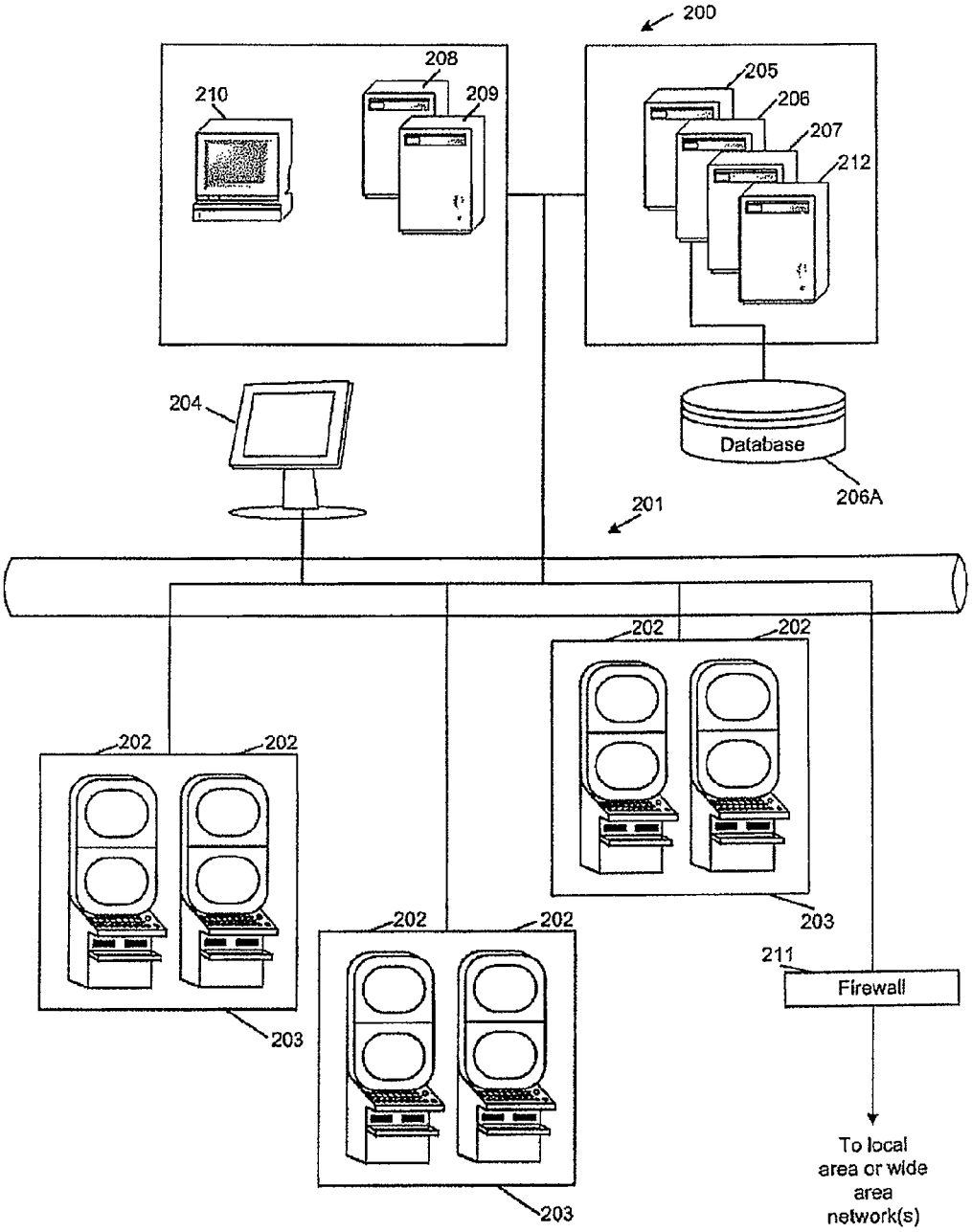
FIG. 6 is a schematic diagram of a gaming system in accordance with an alternative embodiment of the present invention with the gaming system implemented over a network.

FIG. 6 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 10, 44,100 shown in FIGS. 3 and 4, or may have simplified functionality depending on the requirements for implementing game play. While banks 203 of two gaming machines are illustrated in FIG. 6, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a variation of the above thick client embodiment, the gaming machine 202 may implement the game, with the game server 205 functioning merely to serve data indicative of a game to the gaming machine 202 for implementation.

With this implementation, a data signal containing a computer program usable by the client terminal to implement the gaming system may be transferred from the game server to the client terminal, for example in response to a request by the client terminal.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

A loyalty program server 212 may also be provided.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

During operation, the game controller, whether implemented in a stand alone gaming machine 10, 44, 100 or over a network 201, implements a probabilistic game wherein at least during part of the game the gaming system automatically modifies a displayed symbol so that the displayed symbols correspond to an optimum win outcome if such a win outcome is possible.

Examples of specific implementations of the gaming system will now be described in relation to a stand alone gaming machine 10, 44, 100 although it will be understood that implementation may also be carried out using other gaming system architectures such as a network architecture of the type shown in FIG. 6.

In one embodiment, the gaming system is operable in normal game mode and special game mode.

During normal game mode, reels comprising standard symbols and optionally one or more function symbols are provided. Win outcomes are determined on the basis of the symbols visible when the reels stop rotating, and in this example three symbols are displayed on each reel at any time. A win outcome may occur based on display of the same symbol along a horizontal or diagonal line, as scattered symbols, or in any other predefined way. A win outcome may also occur on the basis of one or more standard symbols in combination with at least one function symbol having a predetermined assigned function. For example a function symbol may correspond to a wild function, a scatter function, a multiply function, a repeat win function, and so on.

During special game mode, at least one symbol is automatically modified by the symbol modifier 24 so that the displayed symbols correspond to an optimum win outcome if modification of the symbol will correspond to a win outcome. One or multiple symbols may be modified.

In a first embodiment, modification of a symbol occurs by moving a symbol displayed in an outcome display area to a new display position in the outcome display area. The symbol to be moved may be a function symbol such as a wild symbol.

The symbol which is movable by the symbol position modifier 24 may be any displayed symbol, may be a specific symbol defined at commencement of the game or commencement of special game mode, or may be identified as a movable symbol when the symbol is displayed in a specific position. The movable symbol may be a function symbol, such as a wild symbol.

After movement of a symbol, in subsequent games during special game mode the symbol may remain at the new reel location, or the symbol may revert to the original reel location after each game.

When a symbol is moved from a display position, a randomly selected symbol may replace the moved symbol, a predetermined replacement symbol associated with the display position may be displayed, or the symbol to be moved and a symbol associated with the display position to which the symbol is to be moved may swap positions.

Alternatively, the symbol to be moved may 'replicate' in that the original symbol to be moved remains and the same symbol appears at the new position.

In the example wherein a predetermined symbol is displayed at a display position after movement of a symbol from the display position, the game controller 32 may be arranged to display both the predetermined symbol and the movable symbol at the same display position.

In a second embodiment, modification of a symbol occurs by moving a special symbol displayed outside of the outcome display area into the outcome display area and replacing a symbol in the outcome display area with the special symbol.

In a third embodiment, modification of a symbol occurs by replacing a symbol in the outcome display area with a previously undisplayed special symbol.

In the second and third embodiments, the special symbol may be a function symbol such as a wild symbol.

The gaming system may be arranged to commence special game mode when a predetermined game outcome occurs, and special game mode may comprise one or more free games, in this example three free games. Special game mode may commence automatically on the basis of a game event occurring during a game such as display of a particular symbol, based on game outcomes determined by the gaming system, or may be prompted by a player pressing a button on the gaming system 10, 40, 100 after the player has identified that a game outcome corresponding to special game mode requirements has occurred.

For example, in one arrangement, special game mode may commence when two symbols, such as a sun symbol and a moon symbol, are simultaneously visible in the display area. In this event a previously undisplayed special symbol in the forms of an earth symbol may be used to replace one of the symbols in the display area.

The gaming system 10, 44, 100 may also be arranged so as to determine eligibility for special game mode, for example based on the amount or type of bet placed, based on certain time periods and so on.

Special game mode may also be arranged to commence when a special game is purchased by a player.

Figure 7:
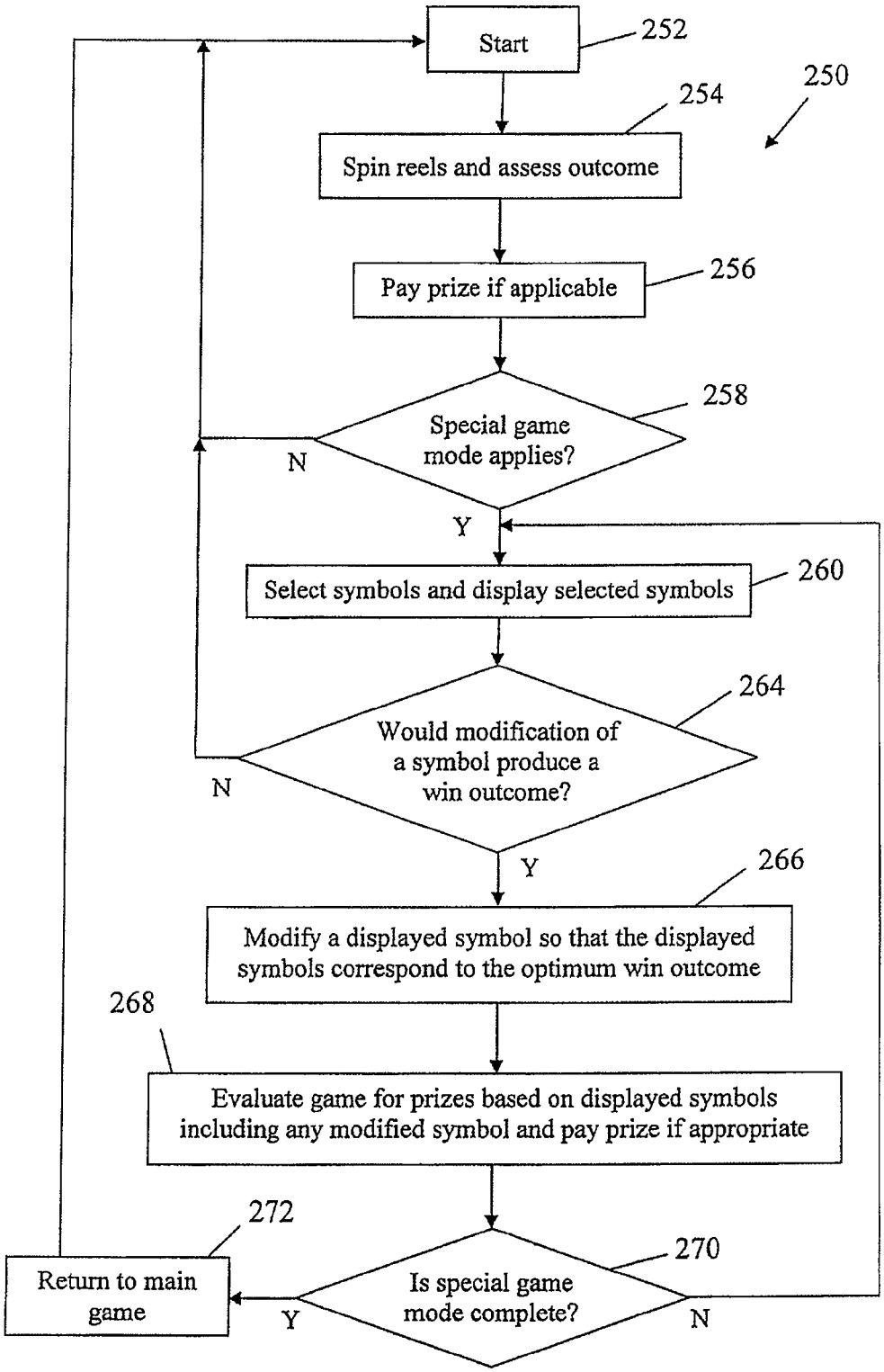
FIG. 7 is a flow diagram illustrating game play of a gaming system in accordance with an embodiment of the present invention.

Specific examples will now be described in relation to flow diagram 250 shown in FIG. 7 which illustrates steps 252 to 272 of a method of gaming implemented by the gaming system according to the present embodiment.

In a first embodiment, five reels are provided, with each reel having multiple symbols. The reels are virtual reels and, as such, representations of the reels are displayed on a graphical display device 48 in a display area 45. Example representations shown on the display device 48 are shown in FIG. 8.

The gaming system 10, 44, 100 is operable in normal game mode and special game mode.

When a predetermined condition occurs during normal game mode, for example based on occurrence of a predetermined game outcome, by a player pressing a button after the player has identified that requirements for special game mode have been met, or in any other way, the gaming system 10, 44, 100 implements special game mode. Commencement of special game mode may be communicated to a player in any suitable way, for example by displaying an icon on the graphical display.

During special game mode, first, second, third, fourth and fifth reels 304, 306, 308, 310 and 312 rotate and the reels stop with three symbols displayed on each reel.

The outcome generator 28 evaluates the displayed symbol combination and if the display positions of the symbols correspond to a win outcome a prize is awarded.

In this example, the symbol combination corresponds to a win outcome including three 9s in line 2, as shown in FIG. 8*a*. An appropriate prize corresponding to three 9s is then awarded to the player.

In this example, a predetermined symbol is selected as the symbol which is movable by the symbol position modifier 24, and the symbol position modifier 24 is arranged to move the predetermined symbol to a new location corresponding to an optimum win outcome if a win outcome is available. The optimum win outcome in this example is the win outcome which corresponds to the maximum payout.

In the present example the predefined symbol is a Wild symbol 320 appearing on the second line of the third reel 308. The Wild symbol 320 substitutes for all other symbols.

As shown in FIG. 8*b*, the symbol position modifier 24 then moves the Wild symbol 320 from the second line of the third reel 308 to a third line of the second reel 306 in order that the displayed symbol combination may correspond to the optimum win outcome, in this example a win outcome including four Jackpot symbols in line 3. An appropriate prize for four Jackpots is then awarded to the player.

It will be understood that in the present example, the game controller 32 is arranged so as to replace the moved symbol with a predetermined symbol and in this example the predetermined symbol is a 10 symbol.

In a second embodiment, five reels are provided, with each reel having multiple symbols. The reels are virtual reels and, as such, representations of the reels are displayed on a graphical display device 44 in a display area 45. Example representations shown on the display device 44 are shown in FIGS. 9*a* and 9*b*.

During special game mode, first, second, third, fourth and fifth reels 304, 306, 308, 310 and 312 rotate and the reels stop with three symbols displayed on each reel.

The outcome generator 28 evaluates the displayed symbol combination and if the display positions of the symbols correspond to a win outcome a prize is awarded. In this example the symbol combination shown in FIG. 9*a* does not correspond to a win outcome so no prize is paid.

In this example, a special symbol which is not displayed in the display area 45 replaces a symbol in the display area 45, with the symbol to be replaced being selected such that the displayed symbols correspond to an optimum win outcome if such a win outcome is available.

As shown in FIG. 9*b*, in the present example the special symbol is a previously undisplayed Cashman symbol 322 and the symbol modifier 24 selects a display position for the Cashman symbol 322 which corresponds to an optimum win outcome, in this example a display position on the third line of the second reel 306. The Cashman symbol 322 in this example corresponds to a wild symbol and, as such, the Cashman symbol 322 substitutes for all other symbols. The outcome generator 28 then evaluates the displayed symbols and an appropriate prize is awarded to the player for four Jackpot symbols appearing on the third line.

As an alternative to the second embodiment, the Cashman symbol 322 may be displayed outside the display area 45 and moved by the symbol modifier 24 from the display position outside the display area 45 to a display position in the display area 45.

While the above examples are described in relation to a gaming system comprising virtual spinning reels provided with symbols, it will be understood that the invention is applicable to other gaming systems wherein symbols are randomly displayed and the game outcome displayed is determined based on the symbols. For example, the invention may be applied to a gaming system arranged to implement a bingo style game, a Keno game or a card style game.

Figure 10:
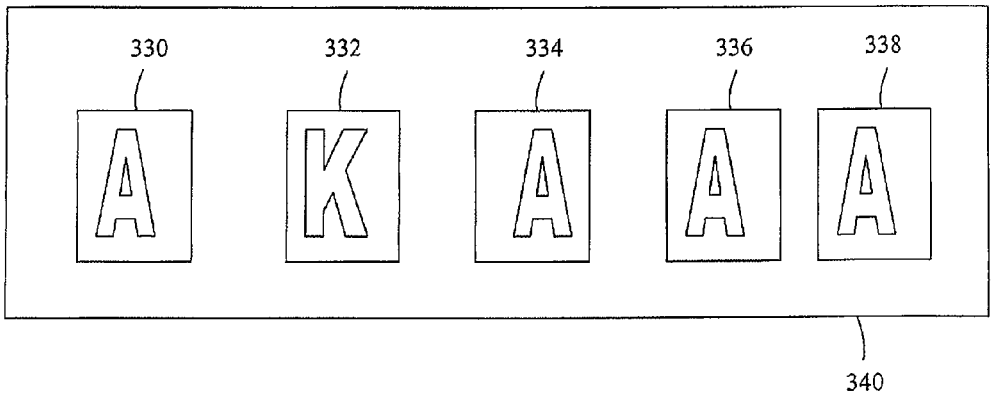
FIGS. 10 and 11 are diagrammatic representations of example displayed symbols of a gaming system in accordance with an embodiment of the present invention during implementation of a game.

For example, in a third embodiment instead of virtual reels five randomly selected cards 330, 332, 334, 336, 338 are displayed in a display area 340, as shown in FIG. 10.

The card game in this embodiment is a poker-type card game and, accordingly, win outcomes are determined on the basis of five cards displayed in a display area 340 with prizes being awarded according to the card combination displayed.

The outcome generator 28 evaluates the displayed card combination and in this example the symbol combination corresponds to a win outcome including four aces. Accordingly, a prize is paid for four aces.

A special card which is not displayed in the display area 340 replaces a card in the display area 340 with the card to be replaced being selected such that the displayed cards correspond to an optimum win outcome if such a win outcome is available.

Figure 11:
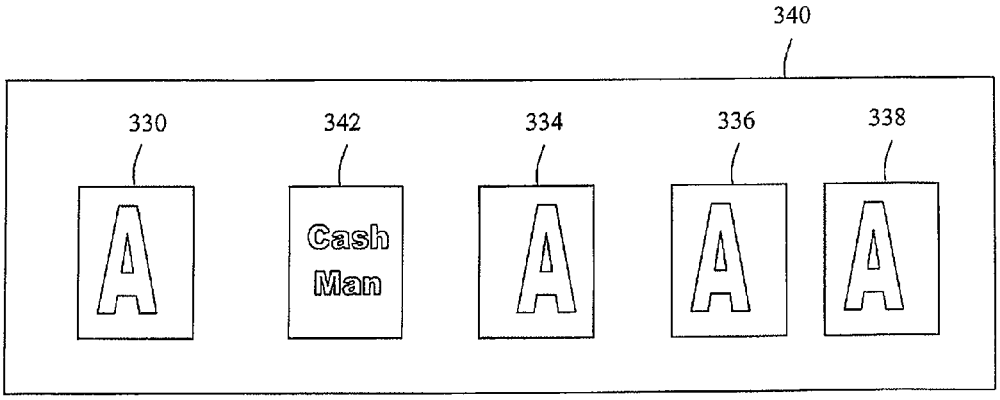

As shown in FIG. 11, in the present example the special card is a Cashman card 342 and the symbol modifier 24 selects a card 330, 332, 334, 336, 338 to be replaced by the Cashman card 342, in this example the second card 332. The Cashman card 342 in this example corresponds to a wild card.

The outcome generator 28 then evaluates the displayed card combination and in this example the card combination corresponds to a win outcome including five aces, and an appropriate prize is paid for five aces.

Modifications and variations as would be apparent to a skilled addressee are deemed to be within the scope of the present invention.

The invention claimed is:

1. A gaming system for playing a game having a normal game mode and a special game mode, the gaming system comprising:

a credit input mechanism configured for player interaction to receive a credit input in the form of a physical item representing a monetary value for establishing a credit balance, the credit balance being increasable and decreasable based at least on wagering activity;

hardware meters configured to monitor the credit input having been provided by the credit input mechanism;

a manually operable player interface configured to place a wager, in accord with said credit balance having been provided by the credit input mechanism, and to receive a physical interaction associated with the special game mode of the game;

a game display having a display area having a plurality of display positions;

a symbol selector configured to, in accord with the placed wager, randomly select a plurality of symbols from a set of symbols, said plurality of symbols being configured for display in said display area of the game display as graphical representations of a plurality of reels, each reel including a plurality of the selected plurality of symbols, said set of symbols including a specific game symbol predetermined to be moveable for display in display area of the game display, and to display said plurality of symbols in said display area of said display;

an outcome generator configured to determine a game outcome based on the plurality of symbols randomly selected for display in said display area and to award a first prize when the plurality of symbols correspond to a first win outcome; and a symbol modifier configured to determine whether the displayed symbols—include the specific game symbol, and, in response to said manually operable player interface having received the physical interaction associated with the special game mode, to determine whether an optimum win outcome is achievable through modification of a displayed symbol of the plurality of displayed symbols at a first display position, said optimum win outcome providing the highest monetary payout; and wherein, if an optimum win is achievable, and the displayed symbols include the specific game symbol in a second display position, the symbol selector is further configured to randomly select an additional game symbol, and the automated symbol modifier is further configured (1) to automatically remove said displayed symbol from the first display position, (2) to move the displayed specific game symbol of the plurality of displayed symbols from the second display position to the first display position on the display and (3) to place at the second position from which the specific game symbol was moved the randomly selected additional symbol, while keeping the remaining displayed symbols in the remaining display positions the same, wherein the displayed specific game symbol of said plurality of displayed symbols in the first display position, in conjunction with said remaining displayed symbols, corresponds to the optimum win outcome; and wherein the automated outcome generator being further configured to award an additional second prize for the optimum win outcome and to increase the credit balance; and a payout mechanism configured to payout value in accordance with the credit balance.

2. A gaming system as claimed in claim 1, wherein only a specific symbol of the set of symbols is eligible for selection as the at least one displayed symbol to be moved.

3. A gaming system as claimed in claim 1, wherein the symbol position modifier is configured to modify at least one symbol only when the gaming system operates in special game mode.

4. A gaming system as claimed in claim 1, wherein the gaming system is implemented as a stand alone gaming machine.

5. A gaming system as claimed in claim 1, wherein the gaming system is implemented across a network.

6. A gaming system as claimed in claim 1, wherein the physical player interface is further configured to commence the special game mode of the game in response to a player having identified the specific game symbol through the physical player interface.

7. A method of gaming in a gaming machine for playing a game having a normal game mode and a special game mode, and having one or more controllers, a credit input mechanism configured for player interaction to receive a credit input in the form of a physical item representing a monetary value for establishing a credit balance, the credit balance being increasable and decreasable based at least on wagering activity, hardware meters configured to monitor the credit input having been provided by the credit input mechanism, a manually operable player interface configured to place a wager, in accord with said credit balance having been provided by the credit input mechanism, and to receive a physical interaction associated with the special game mode of the game, a display having a display area having a plurality of display positions controlled by the one or more controllers, a payout mechanism configured to payout value in accordance with the credit balance, the method comprising:

executing, in accord with the placed wager, an automatic random selection of a plurality of symbols from a set of symbols, said set of symbols including a specific game symbol predetermined to be moveable for display in a display area of the display area of the gaming machine;

displaying said plurality of symbols in said display area of said display, including displaying graphical representations of a plurality of reels, each reel including a plurality of the selected plurality of symbols;

determining, using the one or more controllers, whether the displayed symbols include the specific game symbol, and, in response to said manually operable player interface having received the physical interaction associated with the special game mode whether the plurality of symbols in the display area correspond to a first win outcome;

awarding a first prize in response to the first win outcome;

determining, using the one or more controllers, whether an optimum win outcome is achievable through modification of a displayed symbol of the plurality of displayed symbols at a first display position in the display area, wherein the optimum win outcome has a higher value than the first win outcome and provides the highest monetary payout;

if the optimum win outcome is achievable and the displayed symbols include the specific game symbol in a second display position, (1) randomly selecting an additional game symbol, (2) automatically removing the displayed symbol from the first display position, (3) moving the displayed specific game symbol of the said plurality of displayed symbols from the second display position to the first display position, and (4) placing at the second position from which the specific game symbol was moved the randomly selected additional symbol while keeping the remaining displayed symbols in the remaining display positions the same, wherein the second displayed specific game symbol of said plurality of displayed symbols in the first display position, in conjunction with said remaining displayed symbols, corresponds to the second win outcome;

increasing using the one or more controllers the credit balance; and awarding using the payout mechanism an additional second prize in response to the optimum win outcome.

8. A method as claimed in claim 7, and further including commencing via the physical player interface the special game mode of the game.

9. A method as claimed in claim 7, further comprising designating only a specific symbol of the set of symbols as being eligible for selection as the at least one displayed symbol to be moved.

10. A method as claimed in claim 7, comprising modifying at least one symbol only when the gaming system operates in special game mode.

11. A method as claimed in claim 8, wherein said commencing the special game mode of the game via the physical player interface is in response to a player having identified the specific game symbol through the physical player interface.

* * * * *